US006382572B1

(12) United States Patent
Lin

(10) Patent No.: US 6,382,572 B1
(45) Date of Patent: May 7, 2002

(54) SUPPORTING FRAME FOR GOLF BAG

(75) Inventor: Sen-Te Lin, Changhua Hsien (TW)

(73) Assignee: Nai Hui MFG Enterprise Co., Ltd., Changhua Hsien (TW)

( * ) Notice: Subject to any disclaimer, the term of this patent is extended or adjusted under 35 U.S.C. 154(b) by 0 days.

(21) Appl. No.: 09/884,043

(22) Filed: Jun. 20, 2001

(51) Int. Cl.[7] ..... A63B 55/00
(52) U.S. Cl. ..... 248/96; 206/315.7
(58) Field of Search ..... 248/96, 99, 95, 248/351; 206/315.3, 315.7

(56) References Cited

U.S. PATENT DOCUMENTS 5,154,377 A * 10/1992 Suk ..... 248/96
5,597,144 A * 1/1997 Lee ..... 248/96
5,673,879 A * 10/1997 Hsieh ..... 248/96
5,799,786 A * 9/1998 Beck et al. ..... 206/315.7
5,901,845 A * 5/1999 Cheng ..... 206/315.7
6,315,117 B1 * 11/2001 Han ..... 206/315.7

* cited by examiner

*Primary Examiner*—Anita King
(74) *Attorney, Agent, or Firm*—Bacon & Thomas, PLLC

(57) ABSTRACT

An improved supporting frame for a golf bag is mounted to the upper portion of the rear side of the golf bag. It is symmetric in structure to include two supporting tubes that are controlled by a single pressing button to expand and collect. Each supporting tube is engaged with a pivotal holding seat and a collection mount which has elongated slots so as to permit a rivet secured to each supporting tube to slide back and forth in expansion and collection. Each of two positioning pins slidably engaged with a holding seat respectively is controlled by a control rod that is driven by a pressing button whereby a simple actuation of the pressing button permits the two supporting tubes to extend and collect with ease and speed.

1 Claim, 6 Drawing Sheets

SUPPORTING FRAME FOR GOLF BAG

BACKGROUND OF THE INVENTION

The present invention relates to an improved supporting frame for a golf bag which is mounted to the upper portion of the rear side of the golf bag. It is symmetric in structure to include two supporting tubes that are controlled by a single pressing button to expand and collect. Each supporting tube is engaged with a pivotal holding seat and a collection mount which has elongated slots so as to permit a rivet secured to each supporting tube to slide back and forth in expansion and collection. Each of two positioning pins slidably engaged with a holding seat respectively is controlled by a control rod that is driven by a pressing button whereby a simple actuation of the pressing button permits the two supporting tubes to extend and collect with ease and speed. Besides, the production cost is effectively reduced.

Referring to FIGS. 8, 9, the conventional supporting frame 81 is secured to the upper portion of the golf bag 80 in cooperation with a securing board 82, a driving board 83 and a pivot shaft 84. The bottom of the golf bag has a flat plane 801 and a slant plane 802. The lower end of the supporting frame 81 is associated with the slant plane 802. A first recess (not shown) is disposed between the flat plane and the slant plane, and at the outer edge of the slant plane 802 is disposed a second recess 803. A pair of supporting legs 812 are pivotally secured to a fixing board 811 of the supporting frame 81, and a resilient branch 813 made of steel is engaged with the upper portion of the supporting legs 812. The bottom end of the resilient branch 813 has a flat bending area. The two supporting legs 812 are coupled together by way of a resilient bar 814. The rectangular securing board 82 has a pivot section 821. The driving board 83 has a pivot hinge 831 at one edge with a hook piece 832 at the opposite edge.

In assembly, the securing board 82 is housed in the first recess and the securing board 82 and the driving board 83 are in pivotal engagement with each other by a shaft pin 84 led through the pivot section 821 and the pivot hinge 831 so that the driving board 83 is pivotal about the shaft pin 84. The fixing board 811 of the supporting frame 81 is fixed to the upper portion of the golf bag 80 and the bent lower end of the resilient branch 813 is hooked to the hook piece 832 of the driving board 83.

The expansion and collection of the supporting legs 812 are effected by the driving board 83 disposed at the bottom of the golf bag 80 and the resilient branch 813 that is adjusted to move at one end upwardly or downward to get the supporting legs extended or collected. The driving board 83 is actuated by the weight of the golf bag 80. The actuation of the branch 813 in cooperation with the driving board 83 can effect the operation of the supporting frame 81.

However, such a conventional supporting frame 10 has the following disadvantages in operation:

1. The supporting frame 81 is easily out of function as a result of the quality of the resilient branch 813 and the engagement of the driving board 83 with the hook piece 832.
2. The operation of the supporting frame 81 depends on the elasticity of the resilient bar 814 which is easily out of function as a result of metal fatigue, rendering the supporting legs 812 out of function.
3. The size of the resilient branch 813 must be particularly fit to a golf bag 80 of a specific size, rendering the production cost of the supporting frame 81.

SUMMARY OF THE INVENTION

Therefore, the primary object of the present invention is to provide an improved supporting frame for a golf bag which has two supporting tubes controlled to expand and collect by simple and speedy actuation of a pressing button. The pressing button drives two control rods to pivot so as to actuate two positioning pins each having a journal section to slide into or out of a holding seat respectively whereby two collection mounts can be actuated to drive the supporting tubes to expand and collect effectively with ease and precision.

Another object of the present invention is to provide an improved supporting frame for a golf bag which is equipped with positioning pins, compression springs and torsion springs to drive holding seats to pivot, in combination with rivets each sliding either inwardly or outwardly in elongated insertion slots of two collection mounts so as to make the expansion and collection of supporting tubes in a precise and effective manner.

One further object of the present invention is to provide an improved supporting frame for a golf bag that is produced in a single size to be suit to golf bags of any sizes whereby the production cost can be effectively lowered in practical use.

DETAILED DESCRIPTION OF THE PREFERRED EMBODIMENTS

Figure 1:
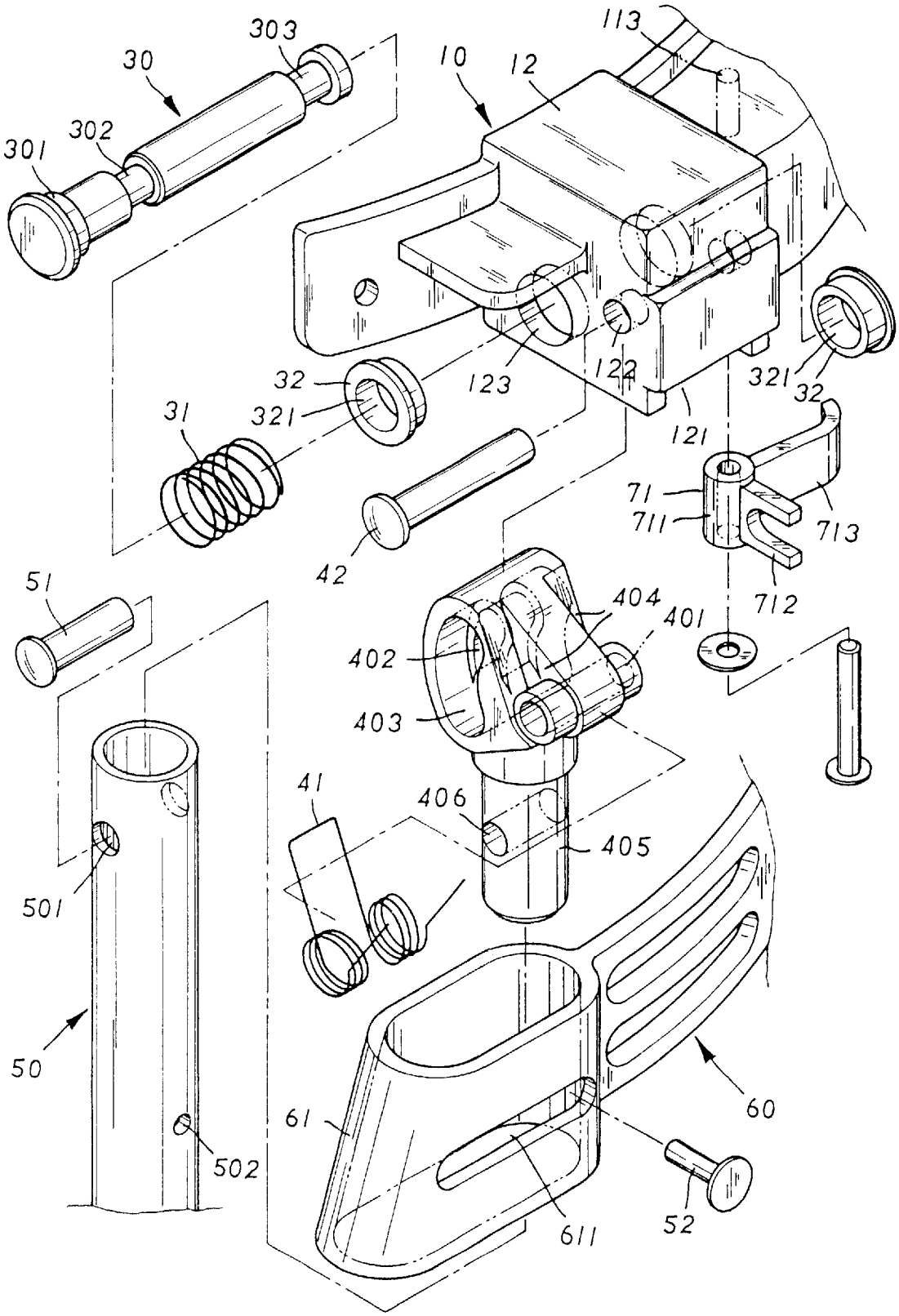
FIG. 1 is a first perspective diagram showing the exploded components of the present invention.
Figure 2:
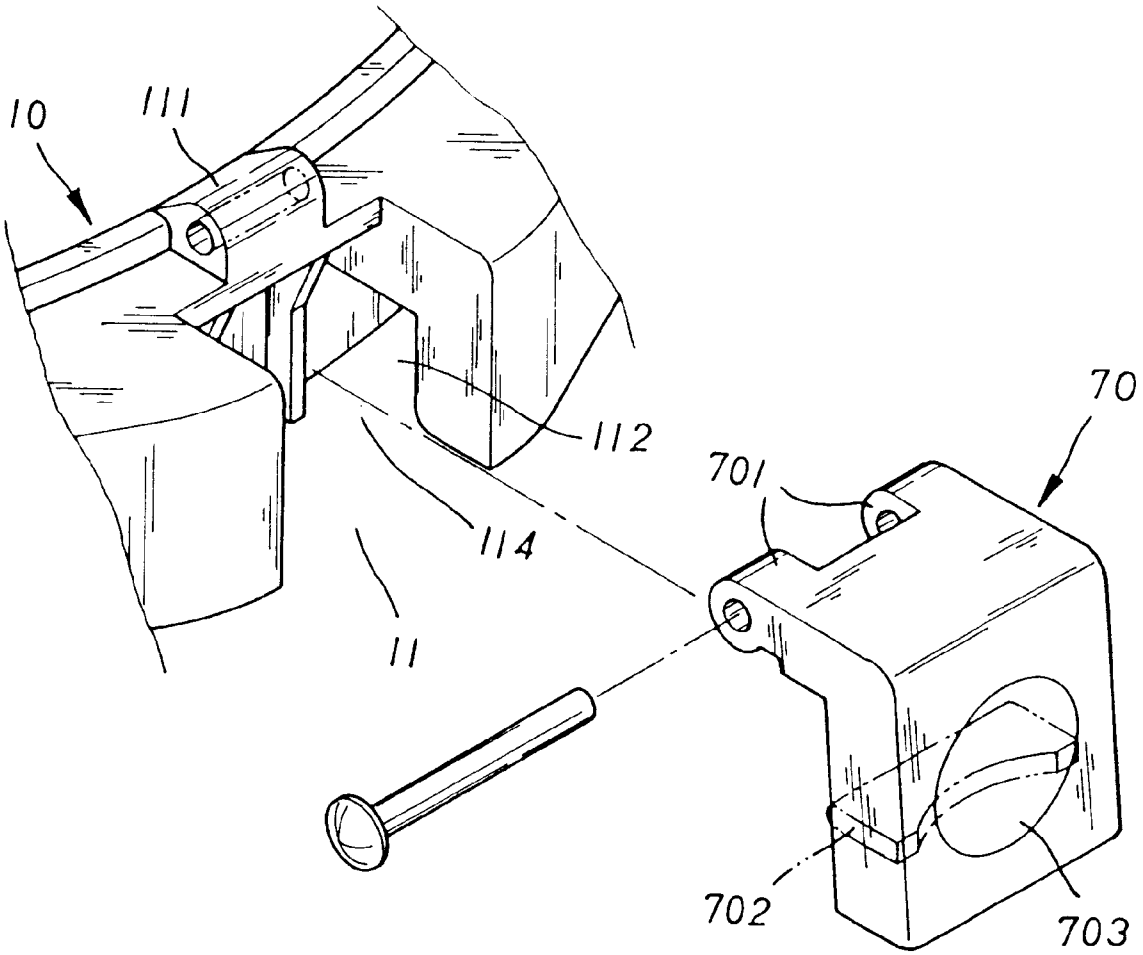
FIG. 2 is a second perspective diagram showing the exploded components thereof.

Referring to FIGS. 1, 2, the supporting frame secured at a position on the upper portion of the golf bag is made up of a main frame 10, two retaining pins 30, two compression springs 31, four limiting sleeves 32, two holding seats 40, two torsion spring 41, two shaft pins 42, two supporting tubes 50, two rivets 51, two retaining rivets 52, a collection mount 60, a pressing button 70 and two control rods 71.

The main frame 10 is structurally symmetric with respect to a golf bag with a pivot receiving recess 11 having a pivot tube 111 defined at the center of the rear side thereof. There is a receiving chamber 112 disposed on each side of the receiving recess 11. Each receiving chamber 112 has an opening 114 in communication therewith. A pivot hole 113 is disposed at the upper and lower portion of the front side of the receiving chambers 112.

The main frame 10 is provided with a pivot block 12 at each external end thereof. At the bottom of each pivot block 12 is disposed a receiving room 121 with a pivot hole 122 defined on each side face of the receiving room 121. A through hole 123 in communication with the receiving chambers 112 is located at the front of the receiving room 121. The positioning pin 30 is cylindrical in structure and of proper length with a bulge headed stop end 301 at one end and a journal section 302 next to the stop end 301 and a slide groove 303 at the other end. The limiting sleeve 32 is a two-staged tube with a through hole 321 defined at the center thereof.

The holding seat 40 has a shaft hole 401 at the top end in connection to an ear-shaped block having a limiting hole 403 with a curved track 402 defined in the limiting hole 403 whose diameter is slightly larger than that of the external diameter of the main section of the positioning pin 30.

The shaft hole 401 is provided with a spring locating groove 404 at each end thereof and a connecting rod 405 extending downwardly from the center of the holding seat 40 has a lateral hole 406 defined at the middle thereof.

At the top section of the supporting tube 50 is disposed a first lateral through hole 501 and down at a distance is disposed a second through hole 502 perpendicular to the first through hole 501.

The collection mount 60 is of a handle shape with an insertion slot 611 disposed on each side wall of a retaining section 61. The pressing button 70 has a pivot connection 701 in the upper section and a pressing area in the lower section thereof. A laterally extended abutment rib 702 is disposed at the center portion on an inner wall of the pressing area with a pressing recess 703 defined on an outer wall of the pressing area.

At the center of the control rod 71 is disposed a pivot tube 711 and a pry fork 712 extending from the pivot tube 711. A hook ended abutment plate 713 is located next and approximately perpendicular to the pry fork 712 with a wide angle defined therebetween.

Figure 3:
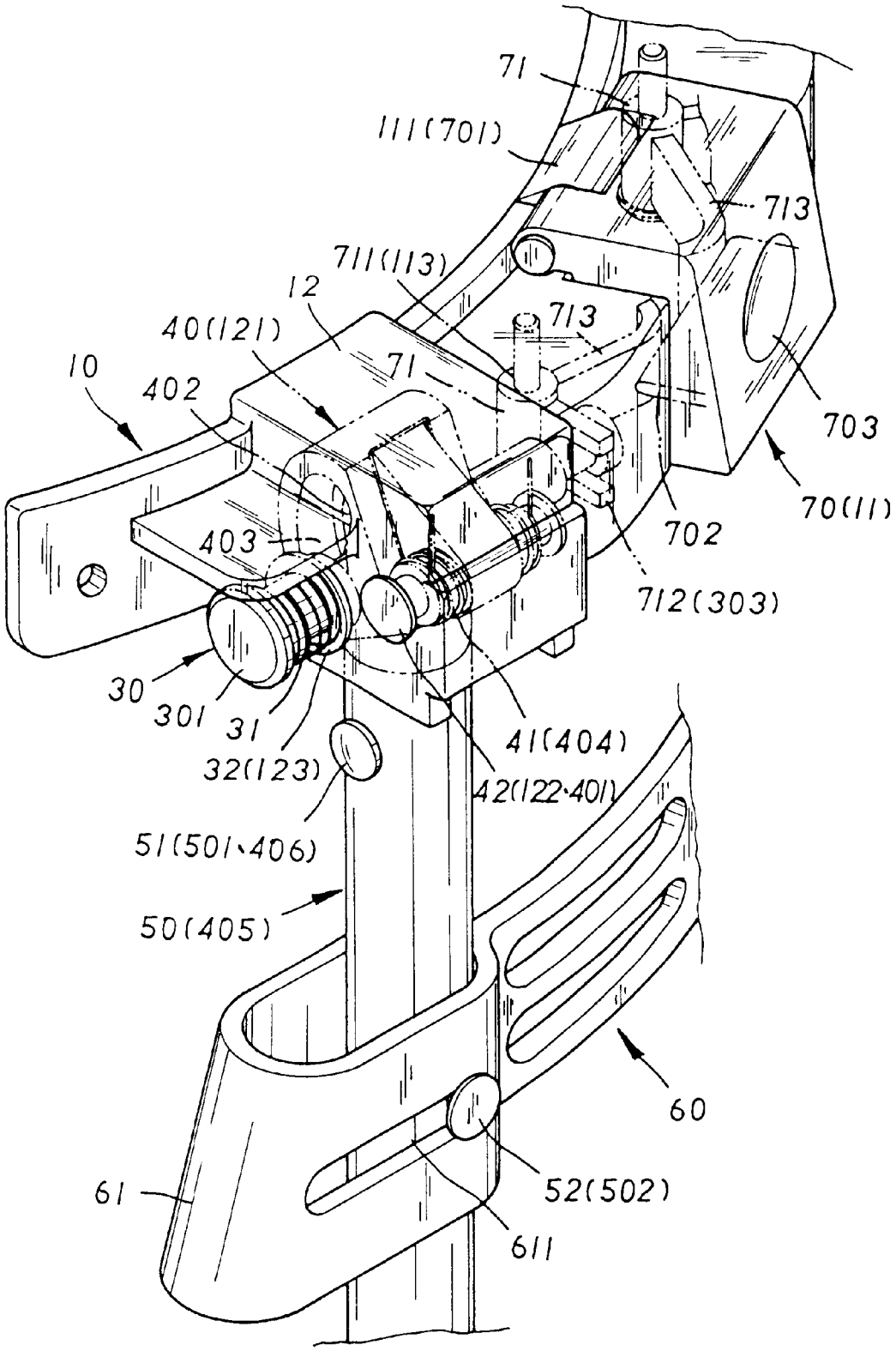
FIG. 3 is a perspective diagram showing the assembly of the present invention.

In assembly, as shown in FIG. 3, the limiting sleeves 32 are first engaged with the through holes 123 of the pivot block 12 of the main frame 10 and then the torsion spring 41 is placed in the spring locating groove 404 of the holding seat 40. Afterwards, it is pivotally engaged with the main frame 10 as a whole. At this time, the torsion spring 41 is subject to a torque force to rotate so as to permit one end of the torsion spring 41 to be located in the spring locating groove 404 and another end placed in the receiving room 121 of the pivot block 12. The shaft pin 42 is led through the pivot hole 122 of the pivot block 12 and the shaft hole 401 of the holding seat 40 to integrally hold the main frame 10 and the holding seat 40 as a whole.

The compression spring 31 is registered with the outer end of the positioning pin 30 and together are they led through the through hole 321 of the limiting sleeve 32 secured to the through hole 123 of the pivot block 12. Thereby the positioning pin 30 is led through the limiting hole 403 of the holding seat 40 and housed in the receiving chambers 112.

Moreover, the control rod 71 is placed in the receiving chamber 112 via the opening 114 of the main frame 10. The pry fork 712 is engaged with the slide groove 303 of the positioning pin 30 with the abutment plate 713 partially projected out of the opening 114. Then a pivot shaft is led to engaged with the pivot tube 711 of the control rod 71 and the pivot hole 113 of the main frame 10 to pivotally combine the control rod 71 with the main frame 10.

The other side of the main frame 10 is of the same structure as that made up of the above listed components. Then, the pressing button 70 is housed in the receiving recess 11 of the main frame 10 and is integrally combined with the main frame 10 by way of a pivot shaft led through the pivot tube 111 and the pivot connection 701. At then, the inner lateral abutment rib 702 is just in abutment against the symmetrically located two abutment plates 713 of the control rods disposed at both sides of the pressing button 70. In the next step, the two supporting tubes 50 are respectively engaged with the retaining section 61 of the collection mounts 60 and the retaining rivet 52 led through the insertion slots 611 of the retaining section 61 is engaged with the through hole 502 of each supporting tube 50 so as to permit the retaining rivet 52 to slidably move inwardly or outwardly within the insertion slots 611 of the collection mount 60. Then the two supporting tubes 50 are respectively engaged with the connecting rod 405 of each holding seat 40 by way of a rivet 51 which is led through the lateral hole 406 of the connecting rod 405 and the first through hole 501 of the supporting tube 50 to complete the pivotal engagement of the supporting tube 50 with the holding seat 40.

Figure 4:
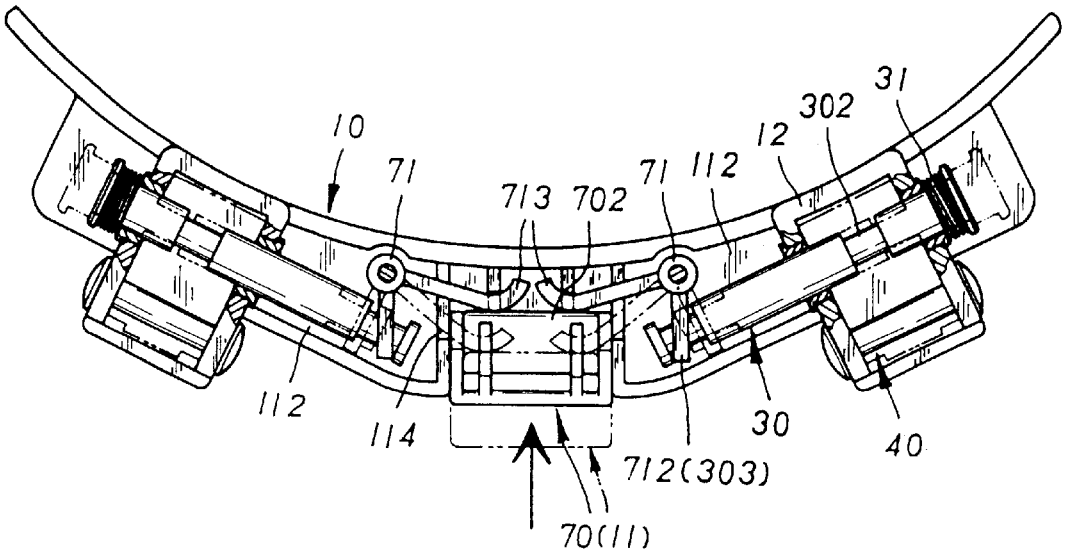
FIG. 4 is a diagram showing the pressing seat being pressed with a finger.

Referring to FIG. 4, to extend the supporting tube outwardly, a user can apply a single finger to urge the pressing recess 703 of the pressing button 70, causing the lateral abutment rib 702 of the pressing button 70 to simultaneously urge the abutment plates 713 of the control rods 71 to move inwardly. At then, each control rod 71 is pivoted about a pivot shaft to rotate inwardly to make the pry fork 712 move inwardly against the positioning pin 30, resulting in the compression of the compression spring 31.

Figure 5:
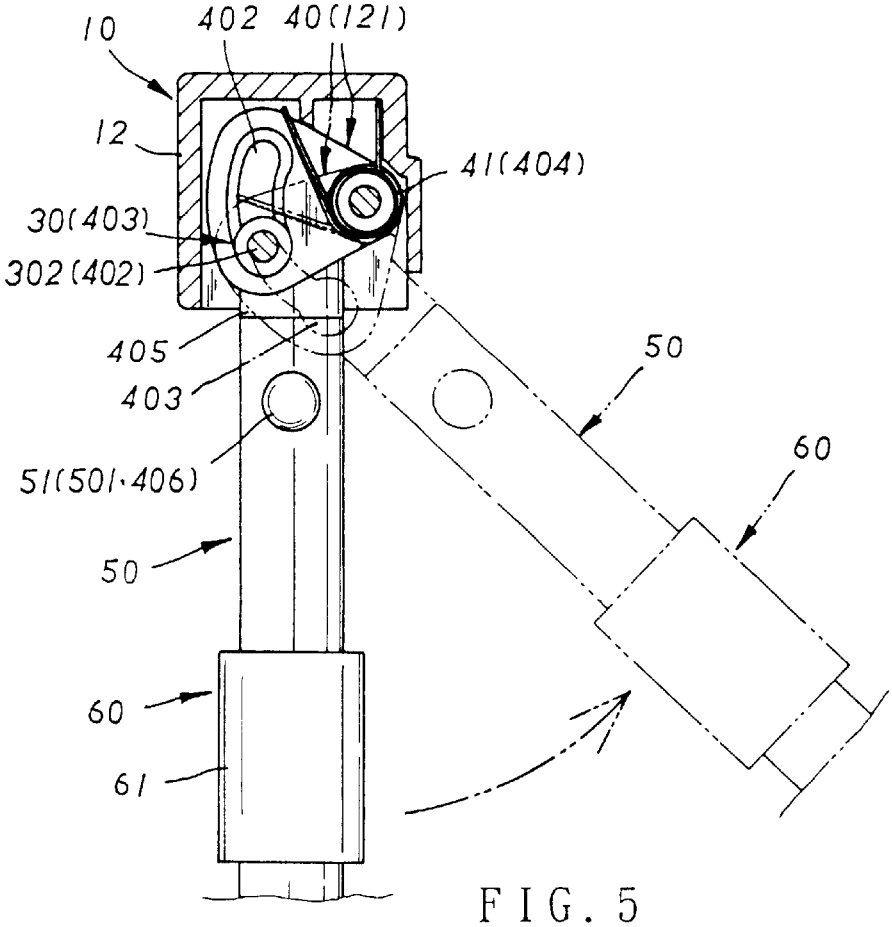
FIG. 5 is a diagram showing the expansion of the supporting rods thereof.

As the positioning pin 30 slides out of the limiting hole 403 of the holding seat 40 with the journal section 302 of the positioning pin 30 located in the limiting hole 403 of the holding seat 40, the collection mount 60 is easily lifted up rearwardly, as shown in FIG. 5, resulting in the retaining pins 52 of the supporting tubes 50 to slide outwardly in the elongated insertion slots 611 of the collection mount 60 to get the supporting tubes 50 expand. In the meanwhile, the holding seat 40 is pivoted downwardly and is pivotally slidable up and down with the curved track 402 of the holding seat 40 engaged with the journal section 302 of the positioning pin 30 so as to make the torsion spring 41 of the holding seat released and urging against the holding seat 40, causing the journal section 302 of the positioning pin 30 to be retained in position at the top end of the curved track 402 to complete the expansion.

Figure 6:
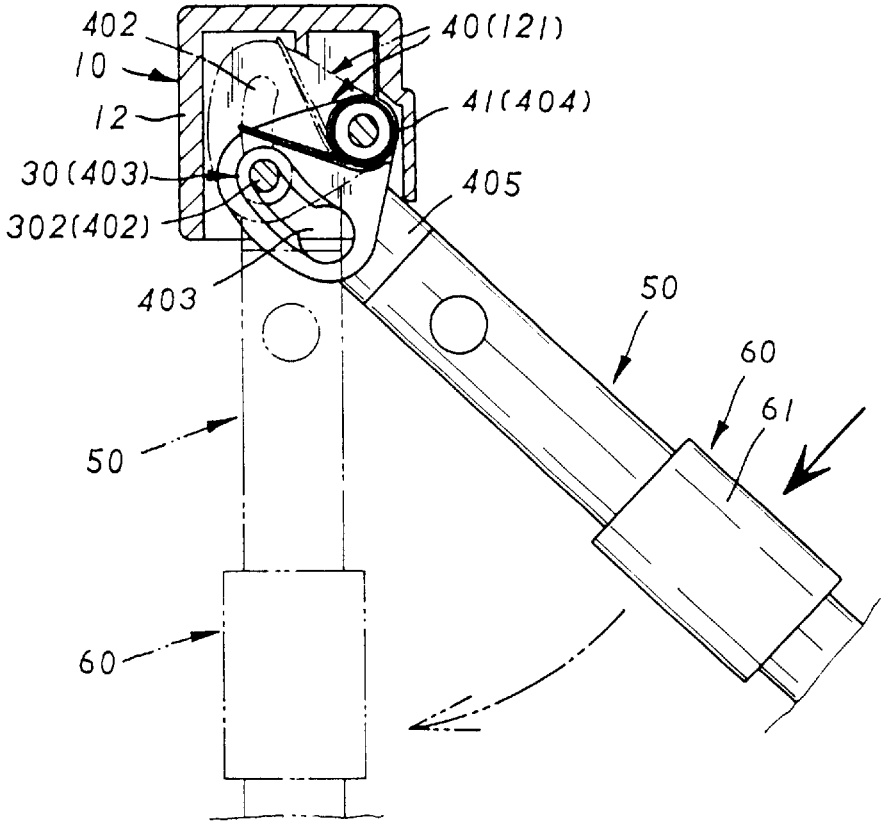
FIG. 6 is a diagram showing the collection of the supporting rods thereof.
Figure 7:
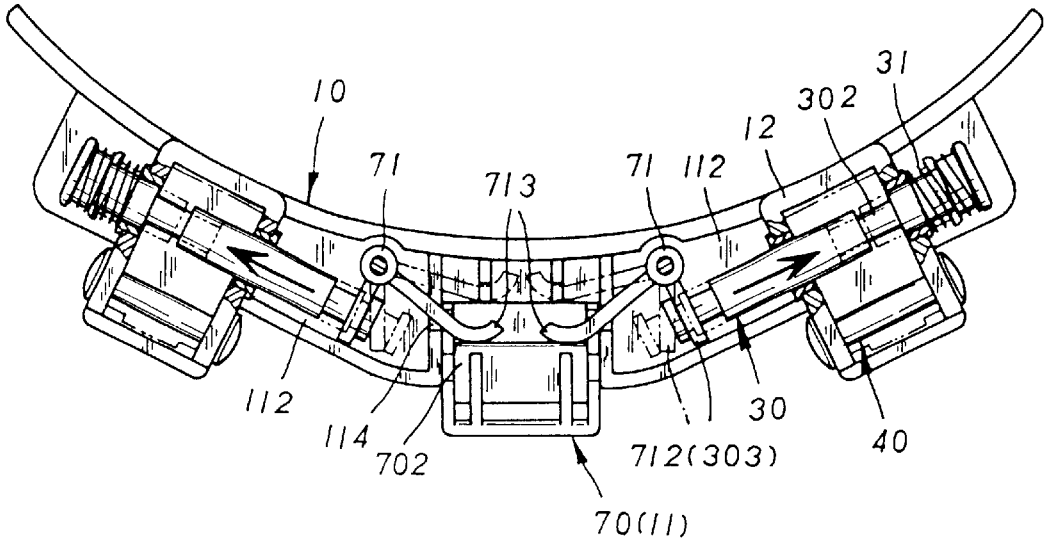
FIG. 7 is a diagram showing the retraction of the actuated pressing seat.
Figure 9:
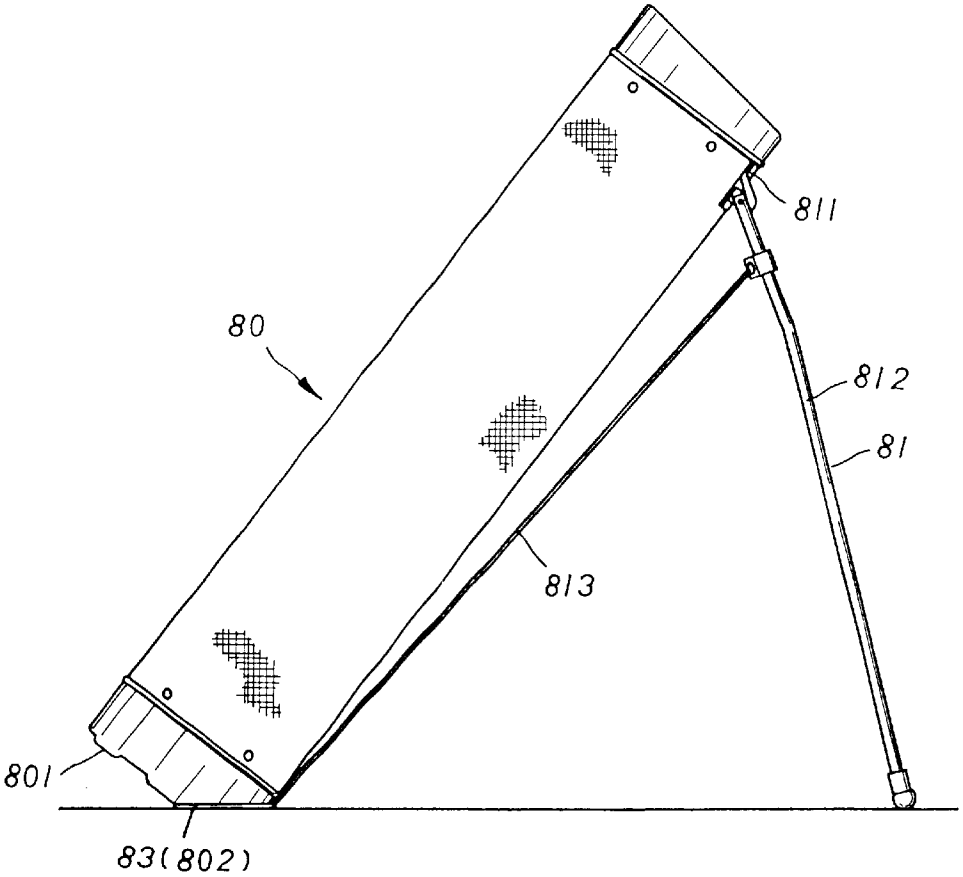
FIG. 9 PRIOR ART
FIG. 9 is a diagram showing the operation mode of the prior art.
Figure 8:
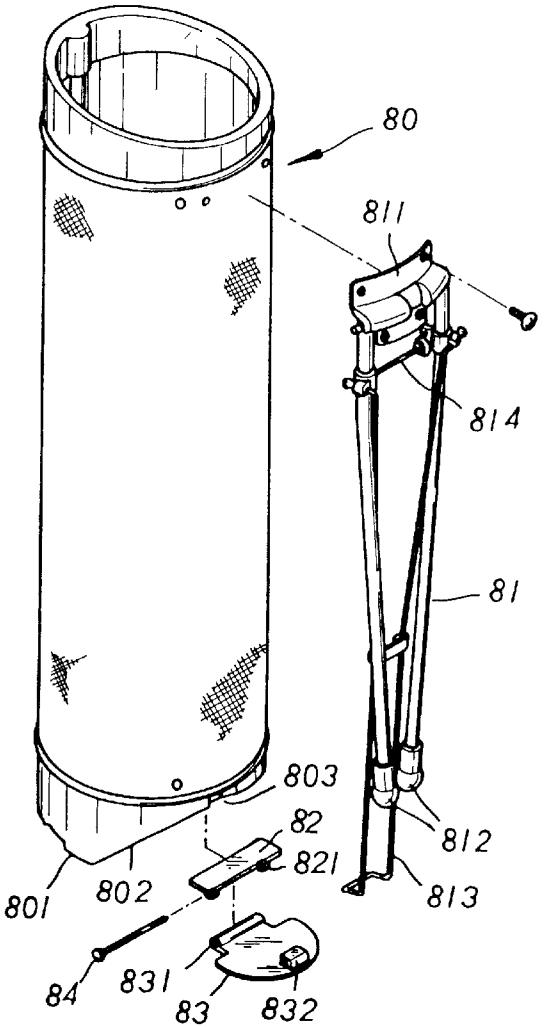
FIG. 8 PRIOR ART
FIG. 8 is a diagram showing the exploded components of a prior art.

To get the supporting tubes 50 collected, as shown in FIG. 6, the collection mount 60 is pushed with force downwardly to bring the retaining pins 52 of the supporting tubes 50 to slide inwardly along the insertion slots 611 of the collection mount 60 for collection. In the meanwhile, the holding seat 40 pivotally slides along the curved track 402 to cause the torsion spring 41 to be subject to a torque again. As the limiting hole 403 of the holding seat 40 is pivoted to the journal section 302 of the positioning pin 30, as shown in FIG. 7, the compression spring 31 is resumed in a non-compressed state, then the positioning pin 30 is pushed outwardly, the journal section 302 of the same is moved out of the limiting hole 403 and the main section of the positioning pin 30 slides into the limiting hole 403 of the holding seat 40. At the same time, the pry fork 712 of the control rod 71 is pushed to move and pivot outwardly with the abutment plate 713 urging the abutment rib 702 of the pressing button 70 so as to get the pressing button 70 to move outwardly and resume its non-operation position. Thus the collection operation is completed.

There are some advantages obtained in the present invention given as follows:

1. One simple actuation of the pressing button 70, which can move inwardly to drive the two control rods 71 to make the journal sections 302 of positioning pins 30 slide into the limiting holes 403 of the holding seats 40, and the collection mount 60 actuates the supporting tubes 50 to expand, makes the operation easy, precise and speedy.

2. As the supporting tubes 50 on both sides of the main frame 10 are extended or collected, the positioning pins 30, the compression springs 31 and the torsion spring 41 together drives the holding seat 40 to pivot for locking in position; and the rivets 52 sliding either inwardly or outwardly for expansion or collection in the insertion slots 611 of the collection mount 60 ensures the expansion or collection in a secure and precise manner without the risk of detachment or shaking in operation.

3. The structure of the present invention can be suit for golf bags of any sizes, so, the present invention is produced in one size to be applied to all types of golf bags, rendering the reduction of production cost.

I claim:

1. A supporting frame for a golf bag secured to an upper portion of the golf bag comprising a main frame, two retaining pins, two compression springs, four limiting sleeves, two holding seats, two torsion springs, two shaft pins, two supporting tubes, two rivets, two retaining rivets, a collection mount, a pressing button and two control rods;

wherein said main frame structurally symmetric has a pivot receiving recess having a pivot tube defined at the center of a rear side thereof; a receiving chamber is disposed on each side of said receiving recess; each receiving chamber has an opening in communication therewith; a pivot hole is disposed at the upper and lower portion of a front side of said receiving chambers;

said pin is cylindrical in structure with a bulge headed stop end at one end and a journal section next to the stop end and a slide groove at the other end and is engaged with one of said compression spring;

each said limiting sleeve is a two-staged tube with a through hole defined at the center thereof;

said holding seat has a shaft hole at a top end in connection to an ear-shaped block and having a limiting hole with a curved track defined in said limiting hole whose diameter is slightly larger than that of the external diameter of a main section of said retaining pin; said shaft hole is provided with a spring locating groove at each end thereof and a connecting rod extending downwardly from the center of said holding seat has a lateral hole defined at the middle thereof;

at the top section of each supporting tube is disposed a first lateral through hole and down at a distance is disposed a second through hole perpendicular to the first through hole; said supporting tube is coupled to said holding seat by a rivet;

said collection mount has a retaining section and has an insertion slot disposed on each side wall of said retaining section;

said pressing button has a pivot connection in the upper section and a pressing area in a lower section thereof; a laterally extended abutment rib is disposed at a center portion on an inner wall of said pressing area with a pressing recess defined on an outer wall of said pressing area;

at the center of each said control rod is disposed a pivot tube; a pry fork extending from said pivot tube; a hook ended abutment plate is located next and approximately perpendicular to the pry fork with a wide angle defined therebetween;

each said supporting tube is movably engaged with said insertion slots of said collection mount by a rivet so as to permit said supporting tube to be extended or collected;

whereby each said retaining pin is slidably engaged with said limiting hole and said connecting rod is coupled to each said supporting tube by a rivet; said holding seat is resiliently pivoted by said torsion spring; said journal section of each said pin is engaged with said pry fork of said control rod and said abutment plate is in contact with said pressing button so as to permit said control rod to pivot to drive said retaining pin associated with each said compression spring to slide back and forth in said holding seat; said holding seat is pivotally secured to said main frame by a rivet and can be selectively retained in place by said torsion spring in expansion of said supporting tubes; and said supporting tubes can be easily collected by simple actuation of said pressing button which drives said control rods and said pry forks, causing said retaining pins to move in a reverse direction to get said retained holding seats free, permitting said supporting tubes to be collected.

* * * * *